US009999304B2

(12) United States Patent
Krishtul

(10) Patent No.: US 9,999,304 B2
(45) Date of Patent: Jun. 19, 2018

(54) LUMBAR SUPPORT CUSHION

(71) Applicant: Max Krishtul, North Miami Beach, FL (US)

(72) Inventor: Max Krishtul, North Miami Beach, FL (US)

( * ) Notice: Subject to any disclaimer, the term of this patent is extended or adjusted under 35 U.S.C. 154(b) by 70 days.

(21) Appl. No.: 15/177,698

(22) Filed: Jun. 9, 2016

(65) Prior Publication Data

US 2017/0347803 A1 Dec. 7, 2017

Related U.S. Application Data

(63) Continuation-in-part of application No. 29/566,933, filed on Jun. 3, 2016, now Pat. No. Des. 793,770.

(51) Int. Cl.
*A47C 7/46* (2006.01)
*A47C 7/42* (2006.01)

(52) U.S. Cl.
CPC ..... *A47C 7/46* (2013.01); *A47C 7/425* (2013.01)

(58) Field of Classification Search
CPC ..... A47C 7/46; A47C 7/425
USPC ..... 297/230.1, 230.12, 284.4, 284.5, 284.3, 297/284.1, 230.14, 284.11
See application file for complete search history.

(56) References Cited

U.S. PATENT DOCUMENTS 2,056,767 A * 10/1936 Blath ..... A61G 7/05723 128/889
4,339,150 A 7/1982 McNamara et al.
4,506,929 A 3/1985 Josefek
4,535,495 A * 8/1985 Oldfield ..... A47C 7/46 297/230.12
4,572,578 A 2/1986 Perkins
4,834,455 A 5/1989 Proctor
4,835,801 A 6/1989 Walpin et al.
4,887,865 A 12/1989 Dawidzon
5,267,947 A 12/1993 James et al.
5,314,235 A 5/1994 Johnson
6,299,248 B1 10/2001 Gennaro et al.
6,687,920 B2 2/2004 Bems
7,055,199 B2 6/2006 Thompson
7,114,776 B1 10/2006 Wiltberger
8,147,000 B1 4/2012 Drake
8,261,386 B2 9/2012 Kardos
(Continued)

OTHER PUBLICATIONS

Allison, 20/2169 Black Lumbar Massage Seat Cushion, retrieved on Jul. 8, 2016. Internet, retrieved from Internet Web Archives May 23, 2014, 1 page, http://web.archive.org/web/*/http://www.amazon.com/Allison-20-2169-Lumbar-Massage-Cushion/dp/B0006MWPZU USA.

(Continued)

*Primary Examiner* — Syed A Islam
(74) *Attorney, Agent, or Firm* — Olav M. Underdal; IDP Patent Services

(57) ABSTRACT

A lumbar support cushion can include a ridged section, right and left protruding side supports, top right and top left protrusions, and a top cutout located between the top right and top left protrusions, which can allow a person sitting against the cushion to experience increased support on the person's lower back. The features of the cushion may promote a healthy sitting posture, proper spine alignment, and may reduce or prevent pain in the lower back. Also disclosed is a method for configuring a support contour of a cushion.

17 Claims, 9 Drawing Sheets

(56) References Cited

U.S. PATENT DOCUMENTS

| | | | | |
|---|---|---|---|---|
| 8,740,303 | B2 | 6/2014 | Halliday et al. | |
| 2007/0096523 | A1 | 5/2007 | Greene | |
| 2011/0006570 | A1* | 1/2011 | Nakatsu | A47C 7/024 297/230.1 |
| 2011/0101745 | A1* | 5/2011 | Chen | A47C 7/425 297/230.12 |

OTHER PUBLICATIONS

Unique Imports, Ultra Premium Black Magnetic Seat Cushion retrieved on Jul. 8, 2016. Internet, retrieved from Internet Web Archives, Sep. 27, 2013, 1 page, http://web.archive.org/web/20140523063027/http://www.amazon. com/Premium-Magnetic-Cushion-Unique-Imports/dp/B00EA4JCGA.

Wagan, Leather Lumbar Support Cushion retrieved on Jul. 8, 2016. Internet, retrieved from Internet Web Archives, Jan. 6, 2009, 1 page, http://web.archive.org/web/20090106215718/http://www.amazon. com/Wagan-IN9615-Leather-Support-Cushion/dp/B0013T7OL0.

Pilot Automotive, Pilot SC-275G Gray Seat Cushion with Lumbar Support , Internet, Jun. 26, 2011, 2 pages, Amazon, https://www. amazon.com/Pilot-SC-275G-Cushion-Lumbar-Support/dp/B003LS768M? e=UTF8&*Version*=1&*entries*=0.

* cited by examiner

Lumbar Support Cushion

LUMBAR SUPPORT CUSHION

CROSS-REFERENCE TO RELATED APPLICATIONS

This application is a continuation-in-part of U.S. Design Application No. 29/566,933 filed Jun. 3, 2016.

FIELD OF THE INVENTION

The present invention relates generally to the field of support cushions, and more specifically to support cushions that allows persons having discomfort of the lower back to sit more comfortably.

BACKGROUND OF THE INVENTION

A support cushion aims to provide a comfortable seating experience. Support cushions can either be designed for permanent position in a chair or be designed for portable use in different seating situation, such as for example in different chairs, car seats, and wheelchairs.

Support cushions are well known, and there are several well-known variants of cushions designed to create extra support in the lumbar spine, also known as the lower back, in order to increase comfort while sitting and improve sitting posture, in addition to assisting in the relief of pain due to conditions such as a herniated disc or sciatica. However existing cushion designs generally do not provide adequate support for the spine, and more particularly, the individual vertebrae of the spinal column.

As such, considering the foregoing, it may be appreciated that there continues to be a need for novel and improved devices and methods for contoured cushions designed to fit the shape of and provide additional support to the spinal column.

SUMMARY OF THE INVENTION

The foregoing needs are met, to a great extent, by the present invention, wherein in aspects of this invention, enhancements are provided to the existing model of support cushions.

In an aspect, the lumbar support cushion can include a ridged section comprising a plurality of alternating ridges and depressions, wherein the ridged section can be configured to provide support to a spinal column of a user when the user is seated against the lumbar support cushion, whereby the lumbar support cushion can be configured to stabilize a seating position of the user, thereby providing relief from pressure and pain to a lower back of the user.

In a related aspect, a lumbar support cushion can further include protruding side supports, which can be symmetrical with regard to a top to bottom centerline of the cushion, and which can be configured to support the sides of the user's torso.

In a related aspect, the lumbar support cushion can further include a top right extension and a top left extension, which can be symmetrical with regard to a top to bottom centerline of the cushion, and which can be configured to support the side of the user's back.

In a related aspect, the lumbar support cushion can further include a top cutout, which can be located between the top right and top left extensions, wherein the top cutout can be configured to enhance the support provided to the user's spinal column by the ridged section.

In a related aspect, the ridged section can be configured to align with a shape of the user's spine.

In a related aspect, the lumbar support cushion can be manufactured with an inner core of high-resilience upholstery foam.

In a related aspect, the lumbar support cushion can further include a cushion cover.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
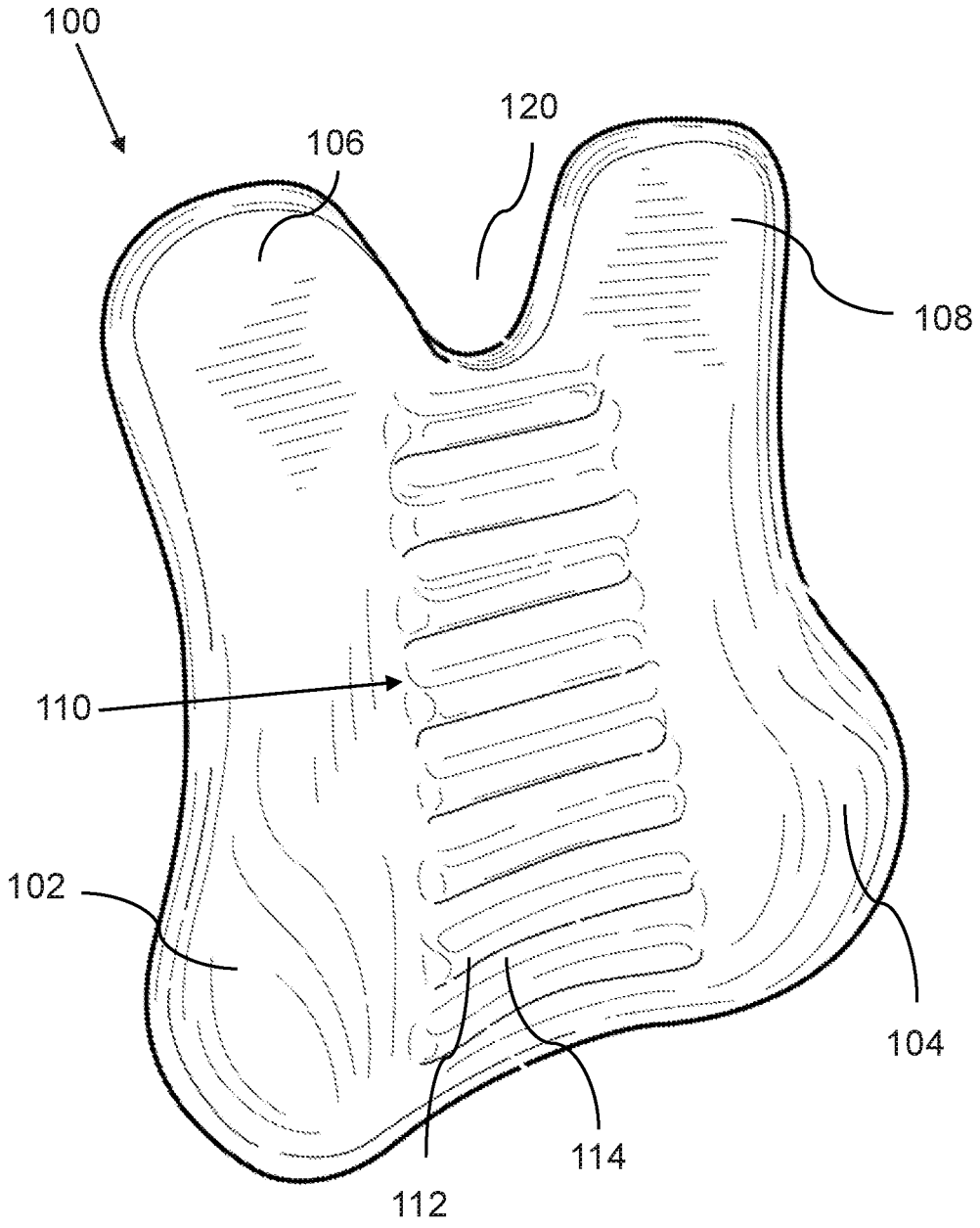
FIG. 1 is a top perspective view of a lumbar support cushion, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a lumbar support cushion with reference to FIG. 1, in such manner that like reference numerals refer to like components throughout; a convention that we shall employ for the remainder of this specification.

Figure 3:
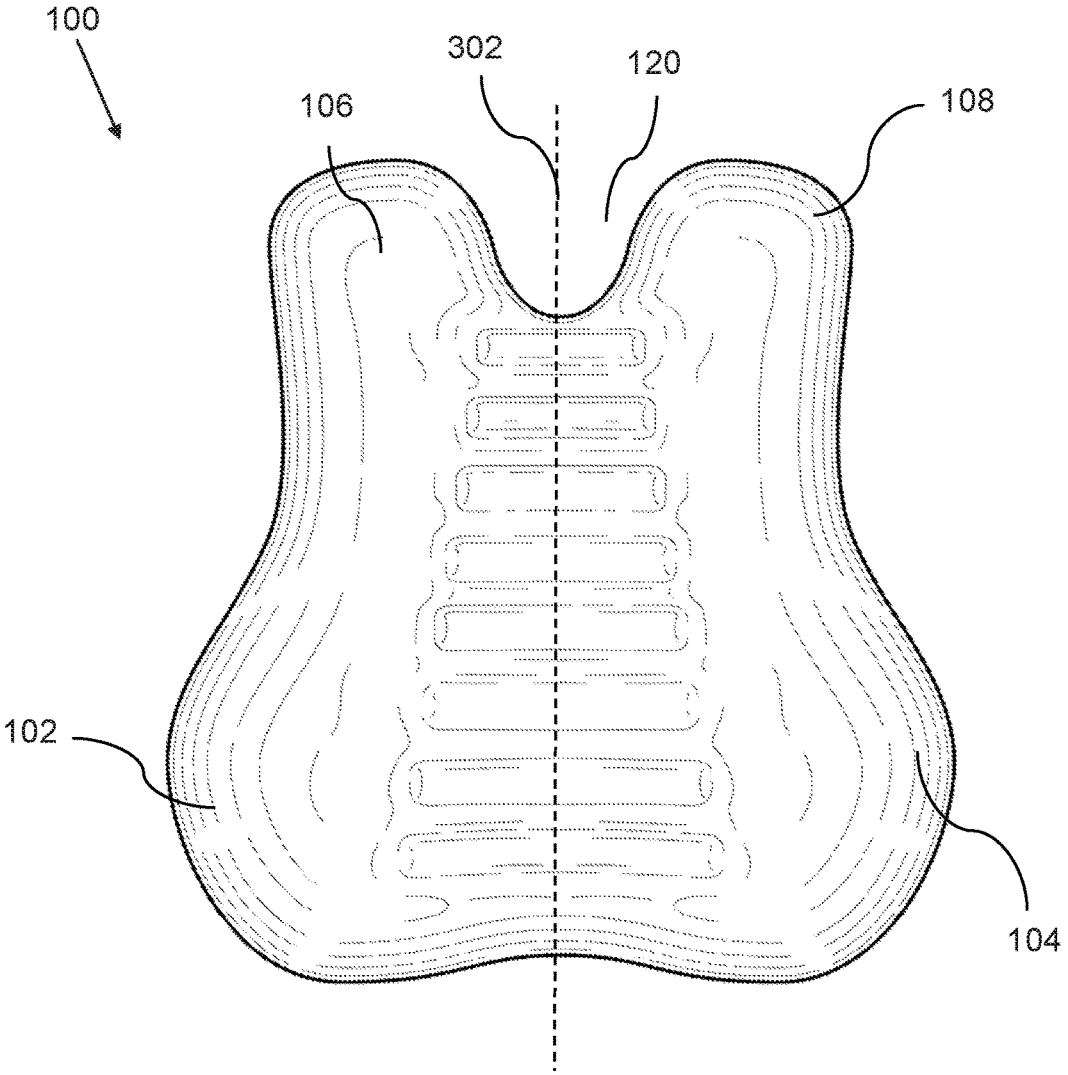
FIG. 3 is a front view of a lumbar support cushion, according to an embodiment of the invention.

In an embodiment, as shown in FIG. 1, a lumbar support cushion 100 can comprise:

a) a ridged section 110, comprising a plurality of alternating ridges 112 and depressions 114;

b) a right protruding side support 102 and an opposing left protruding side support 104;

c) a top right extension 106 and an opposing top left extension 108, wherein the top right extension 106 is positioned in a top right area of the lumbar support cushion 100, and wherein the top left extension 108 is positioned in a top left area of the lumbar support cushion 100; and d) a top cutout 120, which is positioned between the top right and top left extensions 106 108;

wherein the ridged section 110 is configured to be symmetric with respect to the top to bottom centerline 302, as shown in FIG. 3, such that the ridged section 110 is positioned between the right and left protruding side supports 102 104;

wherein the ridged section 110 is configured to provide support to a spinal column of a user when the user is seated against the lumbar support cushion 100;

whereby the lumbar support cushion 100 is configured to stabilize a seating position of the user, thereby providing relief from pressure and pain to a lower back of the user.

Figure 2:
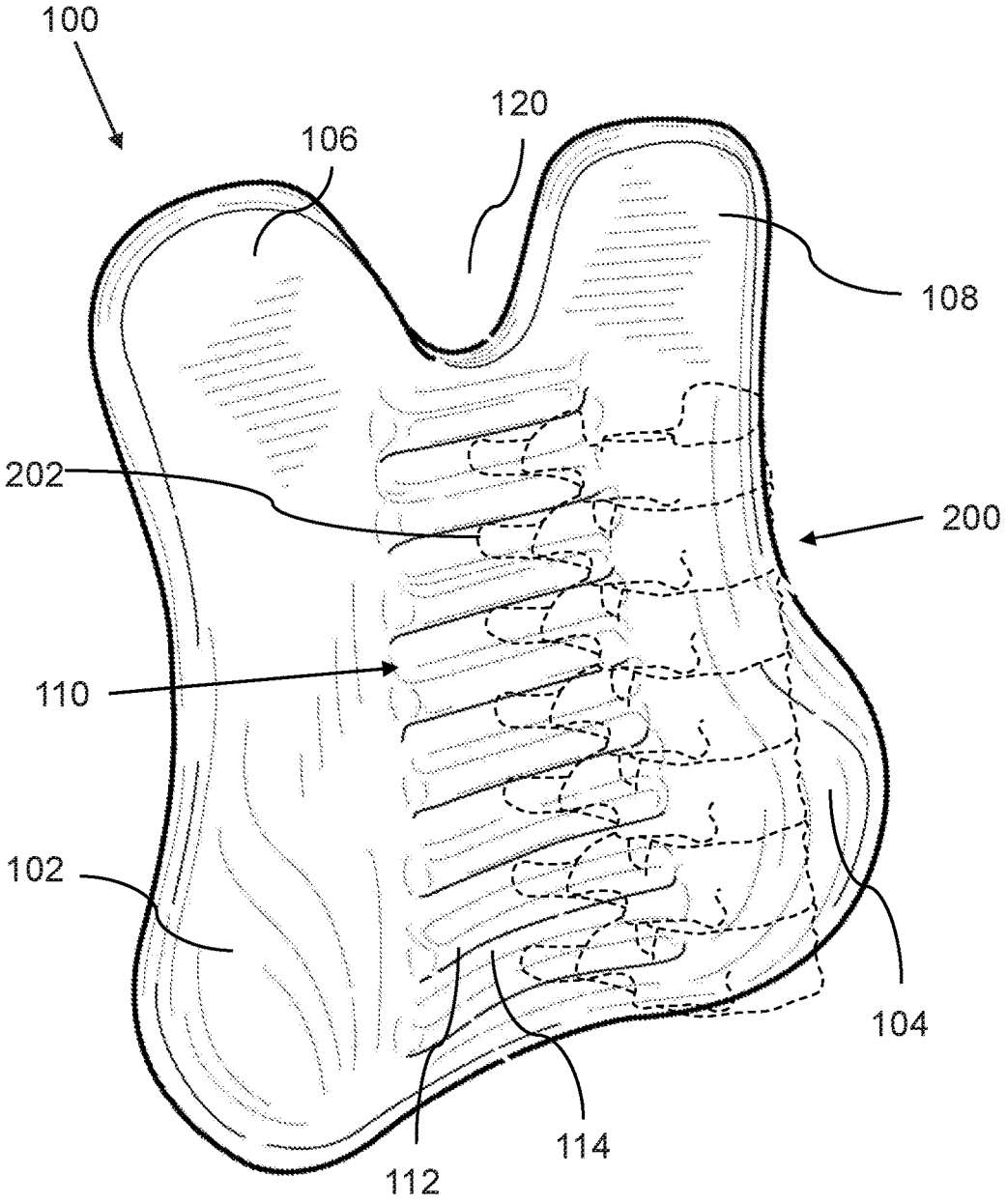
FIG. 2 is a top perspective view of a lumbar support cushion, illustrating by superimposition the approximate seating position and support of a person's skeletal structure, according to an embodiment of the invention.

In a related embodiment, FIG. 2 shows the same view as FIG. 1, and illustrates by superimposition the approximate seating position and support of a person's skeletal structure, shown in dotted lines, when seated in a conventional seating position. The spinal column 200 includes a plurality of a rearwardly projecting bone structures known as spinous processes 202, with each spinous process 202 being associated with a separate vertebra. FIG. 2 illustrates how the ridged section 110 can be configured to align with the structure of the spinal column 200, such that each of the depressions 114 can receive a separate spinous process 202. Furthermore, each of the ridges 112 can be configured to fit into the gap between an adjacent pair of spinous processes 202. The increased support to the spinal column 200 thus offered by the ridged section 110 of the lumbar support cushion 100 allows a person suffering from ailments such as lower back pain to be seated comfortably in the cushion 100.

In a related embodiment, the ridged section 110 can be configured to support a lower portion of the spinal column 200, specifically the lumbar spine. The lumbar spine is also referred to as the lower back, and the two terms are herein used synonymously.

In a related embodiment, as shown in FIG. 2, the right and left protruding side supports 102 104 can be configured to provide support to the sides of a user's torso in a sitting position, thereby improving comfort as well as promoting good posture.

In a further related embodiment, as shown in FIG. 2, the top right and top left extensions 106 108 can be configured to support right and left sides of a user's back. The top cutout 120 can be located between the top right and top left extensions 106 108, whereby the top cutout 120 provides pressure relief to an area of the user's back and/or neck, between the right and left sides of the user's back. Furthermore, the top cutout 120 can be configured to enhance the support provided by the ridged section 110. Since the top cutout 120 is directly above the top of the ridged section 110, the support provided to the spinal column 200 near the top of the ridged section 110 is enhanced when the user relaxes into the lumbar support cushion 100.

In a further related embodiment, the top cutout 120 can be V-shaped. In certain embodiments, the top cutout 120 can be configured as a square, rectangle, or any other suitable shape.

In a related embodiment, as shown in FIG. 3, the shape of the right protruding side support 102 can be symmetrical with the shape of the left protruding side support 104, with respect to a top to bottom centerline 302 of the lumbar support cushion 100. Furthermore, the shape of the top right extension 106 can be symmetrical with the shape of the top left extension 108, with respect to the top to bottom centerline 302.

Figure 4:
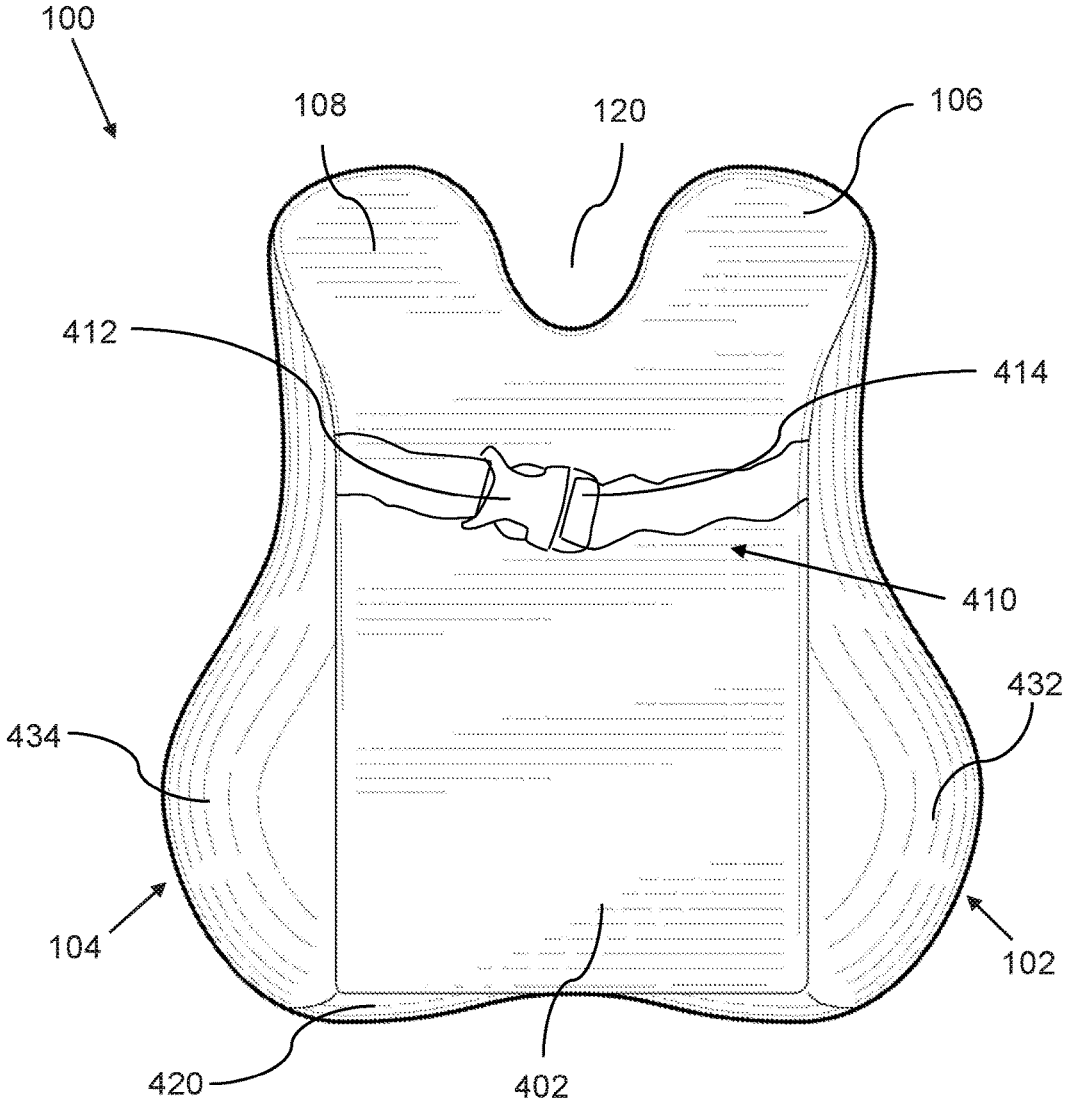
FIG. 4 is a rear view of a lumbar support cushion, according to an embodiment of the invention.

In a related embodiment, as shown in FIG. 4, the lumbar support cushion 100 can include a back strap 410, which is connected to a rear surface 402, configured to secure the lumbar support cushion 100 to a backing surface, such as a chair back. In certain embodiments, the back strap 410 can include a female strap end 412 and a male strap end 414. However, the back strap 410 can also be configured as any suitable securing mechanism as is well-known in the art.

In a further related embodiment, as shown in FIG. 4, the lumbar support cushion 100 can include a bottom surface 420, configured to stabilize the lumbar support cushion 100 against a seating surface, such as the seat of a chair.

Figure 5:
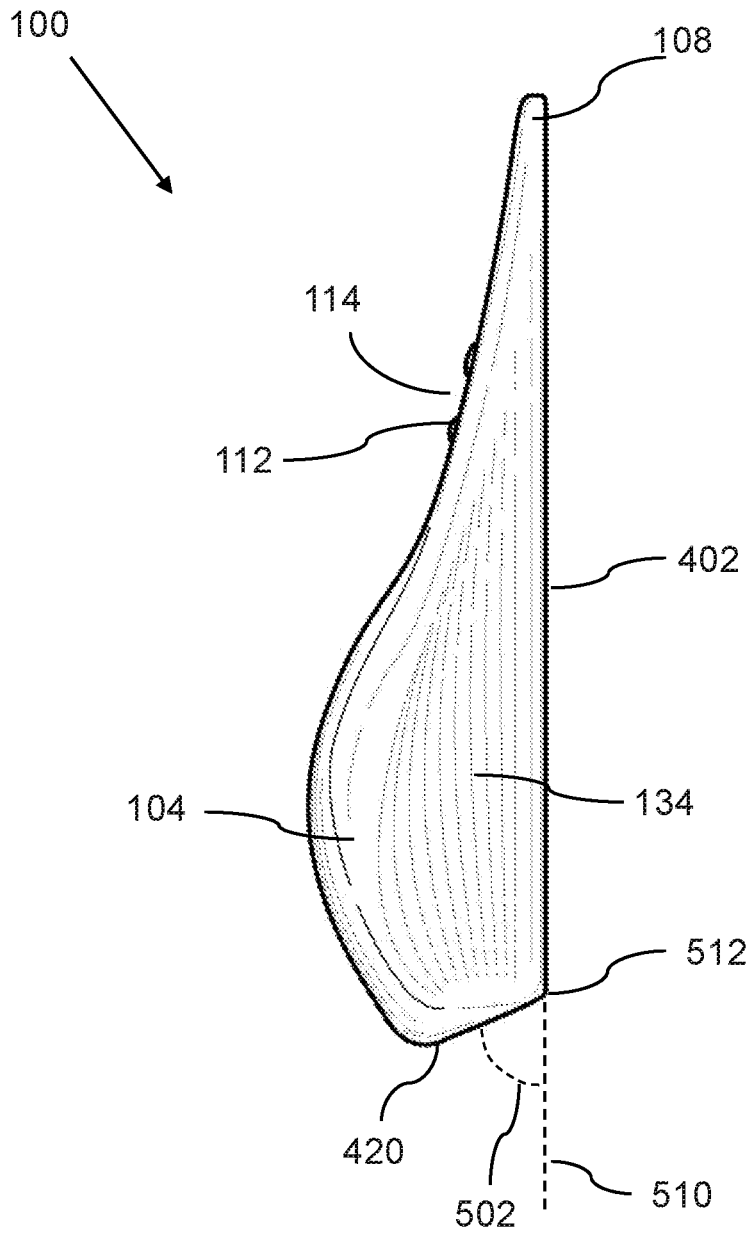
FIG. 5 is a side view of a lumbar support cushion, according to an embodiment of the invention.

In a related embodiment, FIG. 5 shows a side view of the lumbar support cushion 100. In certain embodiments, the rear surface 402 can be a flat surface. In other embodiments, the rear surface 402 can be a curved surface configured to conform to the outer surface of a chair or seat.

In a further related embodiment, as shown in FIG. 5, the bottom surface 420 can be a flat surface oriented at a bottom inclination angle 502, measured as an angle between the bottom surface 420 and a projection line 510 extending from a bottom edge 512 of the rear surface 402 and parallel to the rear surface 402. In certain embodiments, the bottom inclination angle 502 can be in the range of 30 to 60 degrees, 20 to 75 degrees, 10 to 85 degrees, or 10 to 90 degrees. In other embodiments, the angle 502 can be in the range of 90 to 170 degrees.

Figure 6:
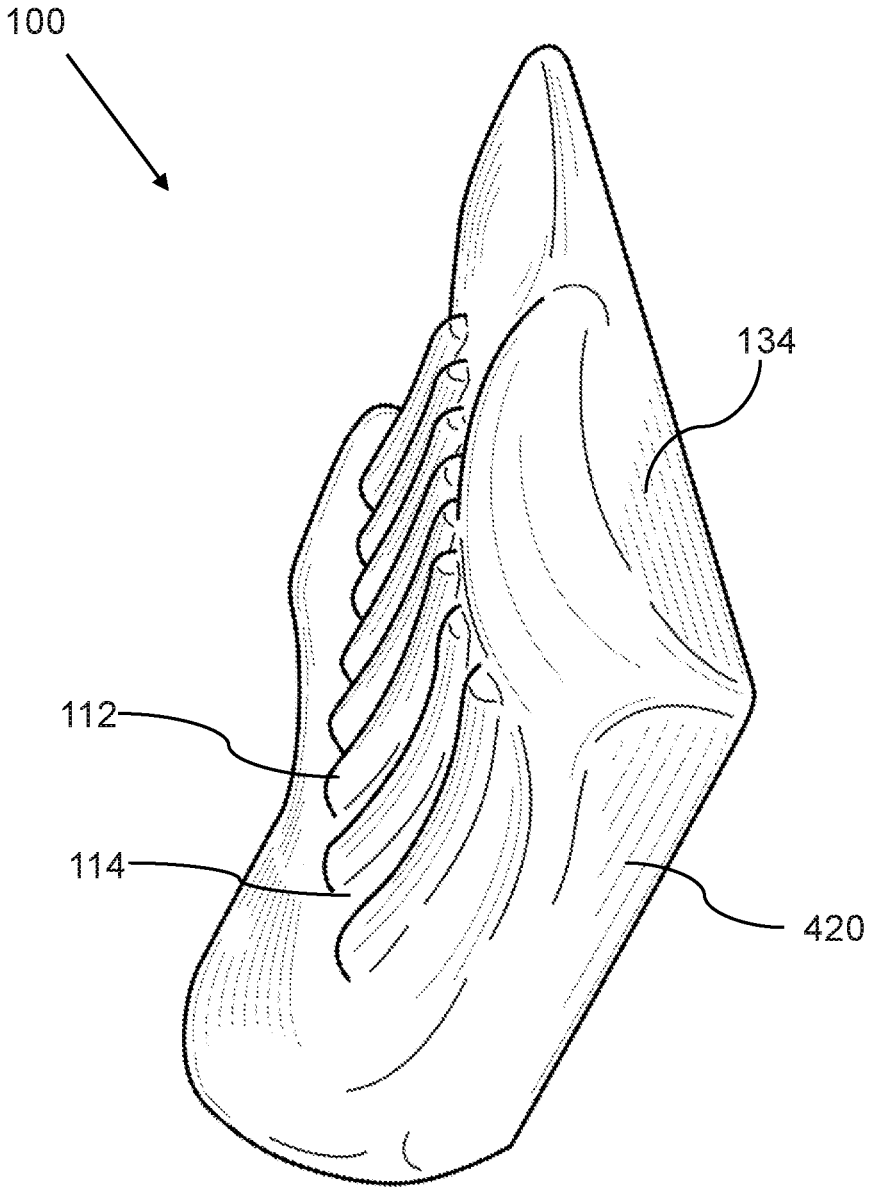
FIG. 6 is a bottom perspective view of a lumbar support cushion, according to an embodiment of the invention.

In a related embodiment, FIG. 6 shows a bottom perspective view of the lumbar support cushion 100. The bottom surface 420 can be configured to conform to a seating surface, such that the lumbar support cushion 100 is prevented from sliding or otherwise moving with respect to the seating surface, thus stabilizing the lumbar support cushion 100 during use by a person.

Figure 7:
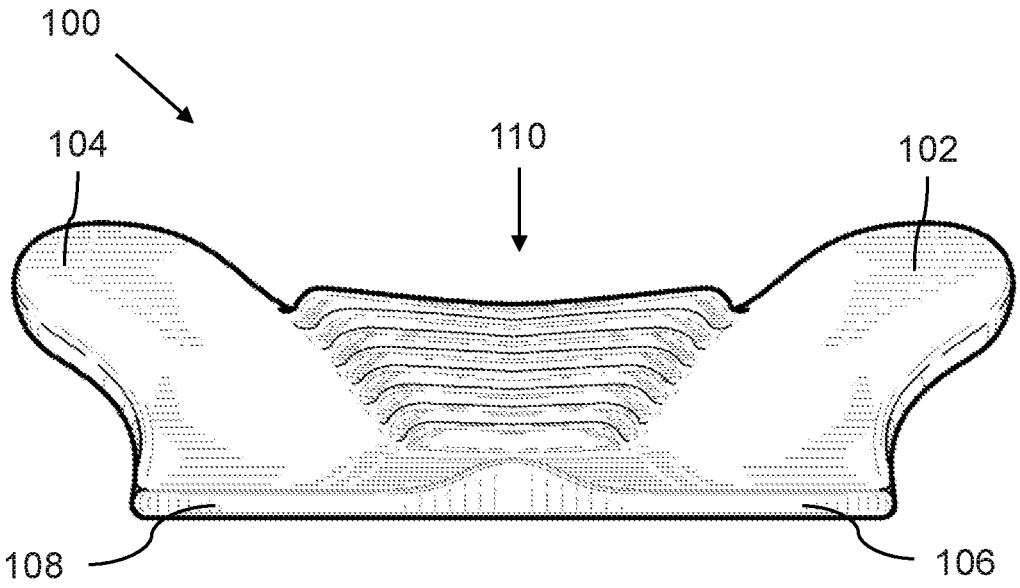
FIG. 7 is a top view of a lumbar support cushion, according to an embodiment of the invention.
Figure 8:
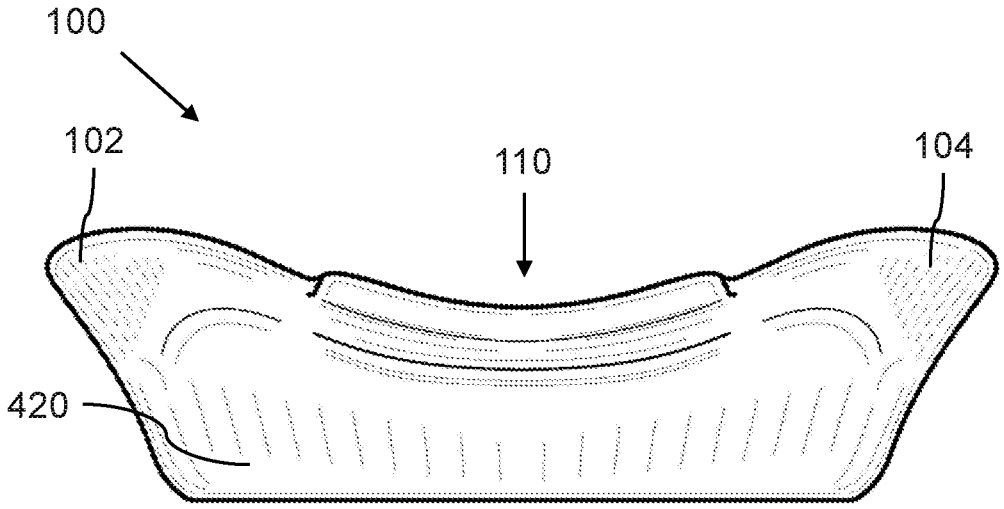
FIG. 8 is a bottom view of a lumbar support cushion, according to an embodiment of the invention.

In related embodiments, FIG. 7 shows a top view of the lumbar support cushion 100, and FIG. 8 shows a bottom view of the lumbar support cushion 100.

Figure 9:
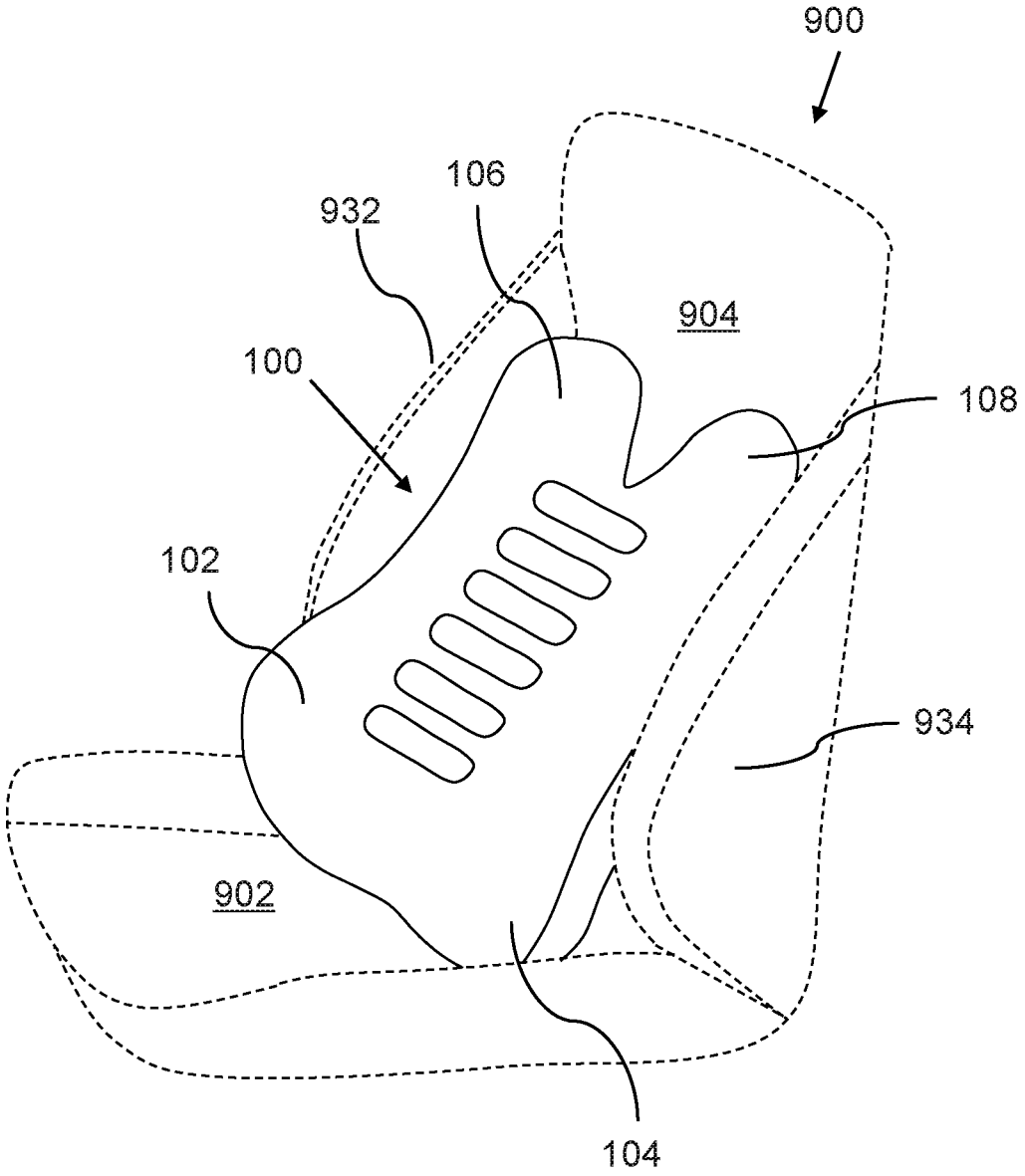
FIG. 9 is a top perspective view of a lumbar support cushion, illustrating the position of the lumbar support cushion within a chair, according to an embodiment of the invention.

In a related embodiment, FIG. 9 illustrates the lumbar support cushion 100 positioned within a seat 900. The seat 900 can be an automobile seat, including a sculpted car seat, or a bucket car seat; an ergonomic chair; or any other type of seat- or chair-related device. The rear surface 402 and bottom surface 420 (not visible in FIG. 8), right and left protruding side supports 102 104, and top right and top left extensions 106 108 can be configured to conform to the shape of the seat 900, such that lumbar support cushion 100 can maintain a secure position within the seat 900 while a user is seated against the cushion 100. The bottom inclination angle 502 of the bottom surface 420 can be configured to adapt to an angle between a seating surface 902 and a back surface 904 of the seat 900.

In a related embodiment, such as shown in FIGS. 4, 5, 6, and 9 the lumbar support cushion 100 can be configured such that right and left rear surfaces 432 434 of the respective right and left protruding side supports 102 104 are configured with a shape that fits with corresponding right and left side supports 932 934 of a seat 900.

Figure 10:
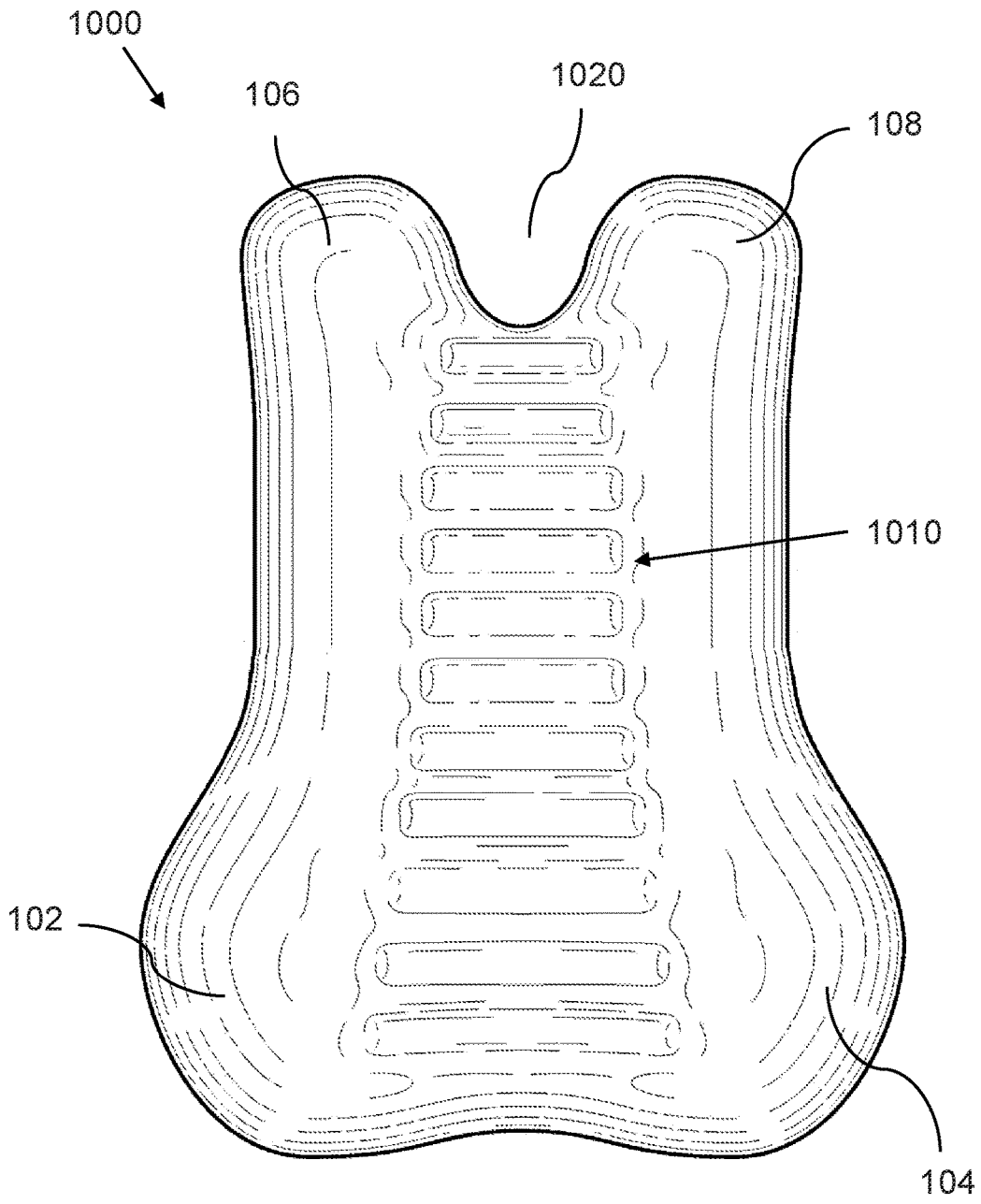
FIG. 10 is a front view of a lumbar support cushion, according to an embodiment of the invention.

In a related embodiment, FIG. 10 shows a lumbar support cushion 1000 with an extended ridged section 1010. The ridged section 1010 can be configured to support the upper back in addition to the lower back, up to and including the thoracic vertebrae in the upper part of the spine. In the embodiment of FIG. 10, the top cutout 1020 can be configured to fit the neck and head of a user, thereby reducing pressure to the neck and head while a user is seated against the lumbar support cushion 1000.

In an embodiment, the lumbar support cushions 100 1000 can be manufactured with an inner core made of a high-resilience upholstery foam, such as for example an open or closed cell flexible polyurethane foam with a density in a range from 20 to 60 kg/m3, whereby the upholstery foam can provide softness to underlying hard surfaces so that sitting can become more comfortable.

In a related embodiment, the upholstery foam can be sufficiently high-resilience and of sufficient density to not flatten out during use, and always regain its shape after use.

In further related embodiments, the lumbar support cushions 100 1000 can be manufactured with an inner core made of other suitable cushioning or upholstery materials, such as gel, memory foam, viscoelastic polyurethane foam, etc.

In a further embodiment, the inner core of the lumbar support cushions 100 1000, can be covered with a cushion cover, which can be made of common cushion cover materials, such as different fabrics, including velour, natural leather, suede, microfiber fabrics, synthetic leather or suede, etc.

In a further related embodiment, the cushion cover can be removable, via well-known methods, such as for example a zipper on the front underside of the cover.

In related embodiments, the lumbar support cushion 100 can:

a) reduce, alleviate, prevent or eliminate back pain by providing support to the spinal column via the ridged section 110; and b) promote a healthy sitting posture, proper spine alignment, and superior comfort.

A method of configuring a support contour or shape of a cushion to promote a healthy sitting posture, can include:

a) configuring a cushion with a ridged back section 110, such that a user's spine can be supported by the ridged back section 110 when the user is seated against the cushion, thus reducing pain and pressure to the lower back;

b) defining protruding side supports 102 104, which can be contoured shapes configured to position, guide and support the sides of the user's torso; and c) making a top cutout 120 in the top area of the cushion, whereby the top cutout is configured to provide pressure relief to an area of the user's back and/or neck, between right and left sides of the user's back.

The many features and advantages of the invention are apparent from the detailed specification, and thus, it is intended by the appended claims to cover all such features and advantages of the invention, which fall within the true spirit and scope of the invention.

Consequently, the various embodiments of the invention described herein are multifold and can be manifested in a large plurality of different cushion designs and shapes.

Many such alternative configurations and shapes are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A lumbar support cushion, comprising:

a ridged section, comprising a plurality of alternating ridges and depressions; and a flat bottom surface, which is configured to stabilize the lumbar support cushion against a seating surface;

wherein the ridged section is configured to provide support to a spinal column of a user when the user is seated against the lumbar support cushion;

wherein the ridged section is configured such that a shape of the plurality of alternating ridges and depressions is configured to align with a shape of a plurality of vertebrae of a spinal column of the user, such that each of the depressions is configured to receive a separate spinous process of the spinal column and each of the ridges is configured to fit into a gap between an adjacent pair of spinous processes of the spinal column;

wherein the flat bottom surface is configured with a bottom inclination angle between the flat bottom surface and a projection line extending from a bottom edge of a rear surface of the lumbar support cushion, wherein the bottom inclination angle is in a range of 10 to 85 degrees;

whereby the lumbar support cushion is configured to stabilize a seating position of the user, thereby providing relief from pressure and pain to a lower back of the user.

2. The lumbar support cushion of claim 1, further comprising:

a. a right protruding side support, which is configured to support a right side of a torso of the user that is seated against the lumbar support cushion; and b. a left protruding side support, which is configured with a shape, which is symmetrical with a shape of the right protruding side support, with respect to a top to bottom centerline of the lumbar support cushion, such that the left protruding side support is configured to support a left side of the torso of the user that is seated against the lumbar support cushion;

wherein the ridged section is configured to be symmetric with respect to the top to bottom centerline, such that the ridged section is positioned between the right and left protruding side supports.

3. The lumbar support cushion of claim 1, further comprising:

a. a top right extension, which is positioned in a top right area of the lumbar support cushion, such that the top right extension is configured to support a right side of the user's back;

b. a top left extension, which is configured with a shape, which is symmetrical with a shape of the top right extension, with respect to a top to bottom centerline of the lumbar support cushion, such that the top left extension is positioned in a top left area of the lumbar support cushion, such that the top left extension is configured to support a left side of the user's back; and c. a top cutout, which is positioned between the top right and top left extensions, whereby the top cutout is configured to provide pressure relief to an area of the users back between the right and left sides of the user's back.

4. The lumbar support cushion of claim 1, further comprising a back strap, which is connected to a rear surface of the lumbar support cushion, such that the back strap is configured to secure the lumbar support cushion to an object.

5. The lumbar support cushion of claim 1, wherein an inner core of the lumbar support cushion is made of open cell flexible polyurethane foam with a density in a range from 20 to 60 kg/m$^3$.

6. The lumbar support cushion of claim 1, further comprising a cushion cover, which covers the lumbar support cushion.

7. The lumbar support cushion of claim 6, wherein the cushion cover is removable.

8. The lumbar support cushion of claim 1, wherein the bottom inclination angle is in a range of 20 to 75 degrees.

9. The lumbar support cushion of claim 1, wherein the bottom inclination angle is in a range of 30 to 60 degrees.

10. The lumbar support cushion of claim 1, wherein the right and left protruding side supports are configured with respectively right and left rear surfaces, which are configured with a shape that fits with corresponding right and left side supports of a seat.

11. A method of configuring a support contour of a cushion to promote a healthy and comfortable sitting position, comprising: configuring a cushion with a ridged back section, the ridged back section defined by a plurality of alternating ridges and depressions, such that a user's spine is supported by the ridged back section when the user is seated against the cushion, thus reducing pain and pressure to a lower back of the user;

wherein the ridged back section is configured such that a shape of the plurality of alternating ridges and depressions is configured to align with a shape of a plurality of vertebrae of a spinal column of the user, such that each of the depressions is configured to receive a separate spinous process of the spinal column and each of the ridges is configured to fit into a gap between an adjacent pair of spinous processes of the spinal column;

wherein a flat bottom surface of the cushion is configured with a bottom inclination angle between the flat bottom surface and a projection line extending from a bottom edge of a rear surface of the lumbar support cushion, wherein the bottom inclination angle is in a range of 10 to 85 degrees.

12. The method of configuring a support contour of a cushion of claim 11, further comprising: defining right and left protruding side supports, which are contoured shapes configured to position, guide and support corresponding right and left sides of a torso of the user;

wherein the ridged section is configured to be symmetric with respect to a top to bottom centerline of the cushion, such that the ridged section is positioned between the right and left protruding side supports.

13. The method of configuring a support contour of a cushion of claim 11, further comprising:

a. defining a top right extension, which is positioned in a top right area of the lumbar support cushion, such that the top right extension is configured to support a right side of the user's back;

b. defining a top left extension, which is configured with a shape, which is symmetrical with a shape of the top right extension, with respect to a top to bottom centerline of the lumbar support cushion, such that the top left extension is positioned in a top left area of the lumbar support cushion, such that the top left extension is configured to support a left side of the user's back; and c. defining a top cutout, which is positioned between the top right and top left extensions, whereby the top cutout is configured to provide pressure relief to an area of the users back between the right and left sides of the user's back.

14. The method of configuring a support contour of a cushion of claim 11, wherein the cushion is further configured with a cushion cover.

15. A lumbar support cushion, comprising: a ridged section, comprising a plurality of alternating ridges and depressions, wherein the ridged section is configured to provide support to a spinal column of a user when the user is seated against the lumbar support cushion; a right protruding side support, which is configured to support a right side of a torso of the user that is seated against the lumbar support cushion; and a left protruding side support, which is configured with a shape, which is symmetrical with a shape of the right protruding side support, with respect to a top to bottom centerline of the lumbar support cushion, such that the left protruding side support is configured to support a left side of the torso of the user that is seated against the lumbar support cushion; and a flat bottom surface, which is configured to stabilize the lumbar support cushion against a seating surface, wherein the ridged section is configured such that a shape of the plurality of alternating ridges and depressions is configured to align with a shape of a plurality of vertebrae of a spinal column of the user, such that each of the depressions is configured to receive a separate spinous process of the spinal column and each of the ridges is configured to fit into a gap between an adjacent pair of spinous processes of the spinal column; wherein the flat bottom surface is configured with a bottom inclination angle between the flat bottom surface and a projection line extending from a bottom edge of a rear surface of the lumbar support cushion, whereby the lumbar support cushion is configured to stabilize a seating position of the user, thereby providing relief from pressure and pain to a lower back of the user.

16. The lumbar support cushion of claim 15, further comprising:

a. a top right extension, which is positioned in a top right area of the lumbar support cushion, such that the top right extension is configured to support a right side of the user's back;

b. a top left extension, which is configured with a shape, which is symmetrical with a shape of the top right extension, with respect to a top to bottom centerline of the lumbar support cushion, such that the top left extension is positioned in a top left area of the lumbar support cushion, such that the top left extension is configured to support a left side of the user's back; and c. a top cutout, which is positioned between the top right and top left extensions, whereby the top cutout is configured to provide pressure relief to an area of the users back between the right and left sides of the user's back.

17. The lumbar support cushion of claim 15, wherein the flat bottom surface is configured with a bottom inclination angle in a range of 10 to 85 degrees.

* * * * *